United States Patent [19]

Ness

[11] 3,998,012

[45] Dec. 21, 1976

[54] ABRADING ARTICLE

[76] Inventor: Reuben Ness, 1028 Pinewood Court, Indianapolis, Ind. 46240

[22] Filed: Apr. 10, 1974

[21] Appl. No.: 459,706

[52] U.S. Cl. ..... 51/391; 15/118; 51/401; 51/407

[51] Int. Cl.[2] ..... B24D 15/04

[58] Field of Search ..... 51/181, 391, 392, 393, 51/394, 401, 406, 407, 205; 15/118, 244 B, 244 C

[56] References Cited

UNITED STATES PATENTS

| | | | |
|---|---|---|---|
| 500,504 | 6/1893 | Moore | 51/392 |
| 1,570,177 | 1/1926 | Pointer | 51/391 X |
| 1,896,946 | 2/1933 | Gauss | 51/205 R X |
| 2,026,638 | 1/1936 | Kingman | 51/181 |
| 2,329,054 | 9/1943 | Kapp | 51/391 |
| 2,438,977 | 4/1948 | Rosemeyre | 51/392 X |
| 2,644,280 | 7/1953 | O'Neil | 51/406 |
| 3,034,267 | 5/1962 | Feeney | 51/391 X |
| 3,267,623 | 8/1966 | Block | 51/406 |

FOREIGN PATENTS OR APPLICATIONS

| | | | |
|---|---|---|---|
| 538,908 | 6/1955 | Belgium | 51/392 |
| 840,484 | 7/1960 | United Kingdom | 51/407 |
| 18,109 | 6/1916 | United Kingdom | 51/181 |

*Primary Examiner*—Al Lawrence Smith
*Assistant Examiner*—Nicholas P. Godici
*Attorney, Agent, or Firm*—Arthur A. Johnson

[57] ABSTRACT

There is disclosed herein an abrasive article having a cylindrical body formed of cellular plastic material having on its bottom surface a layer of abrasive material, such as used for sanding or scouring surfaces, the body being shaped to fit on the palm of a user's hand and being tall enough so that the fingers of the hand using the article cannot conveniently extend below the bottom of the body, the body being resiliently compressible so as to be indented by the user's fingers when firmly gripping the article, and the abrasive material being secured directly to the bottom surface of the body or being carried by paper or cloth which is adhesively secured to the bottom surface of the body. The top of the body may have a layer of mop-like fibrous material which acts as a cushion for the user's hand and may be used to remove dust from the article being sanded or scoured.

1 Claim, 11 Drawing Figures

ABRADING ARTICLE

This invention relates to abrasive articles and more particularly to a hand-held abrasive article which can be used for smoothing the rough surface of wooden or metal articles or other pieces with sand or emery paper, or for scouring pots and pans and other utensils.

An object of this invention is to provide an inexpensive holder for abrasive material which will fit in the palm of the user's hand raised a substantial distance above the surface of the article worked upon so that the fingers of the user's hand when manipulating the article will not likely come in contact with the work and thereby avoid injury to the user's fingers.

This is accomplished by making the body of the article cylindrical so that the fingers of the user's hand can grasp the body as one would grasp a baseball, the end faces of the cylinder being flat so that one flat end of the cylinder engages the palm of the user's hand while the other end carries the abrasive material such as grits or mated strands of sharp-edged plastic material.

In order to improve the user's grip on the cylinder and for the sake of economy, the cylinder of the present invention is made of cellular plastic material which is resiliently compressible so that when the cylinder is gripped by the user's fingers, the material is indented sufficiently by the user's fingers to keep them from slipping off the body and the cylindrical body acts like a cushion, being resiliently compressible axially.

The abrasive material may be applied directly to the bottom surface of the cylinder, but preferably it is carried on a paper or cloth foundation disk provided with adhesive abrasive material on one side and adhesive material on the other side. Preferably the adhesive material on the disks is of the self-adhesive type which is releasable so that the foundation disk may be peeled off the end of the cylinder when the applied disk has lost its usefulness or when it is desired to replace the disk with another disk whose abrasive material is of a different type, for instance, when it is desired to use a disk having less coarse abrasive material.

When the adhesive on the back of the disk is of the self-adhesive type, the disks may be sold as a stack of such disks interleaved with disks of wax or other self-releasing paper.

The cylindrical holders may be molded to shape or may be cut from an extruded cylindrical rod of the material which may advantageously by polystyron foam.

Other features and advantages will appear below.

In the accompanying drawings

Figure 1:
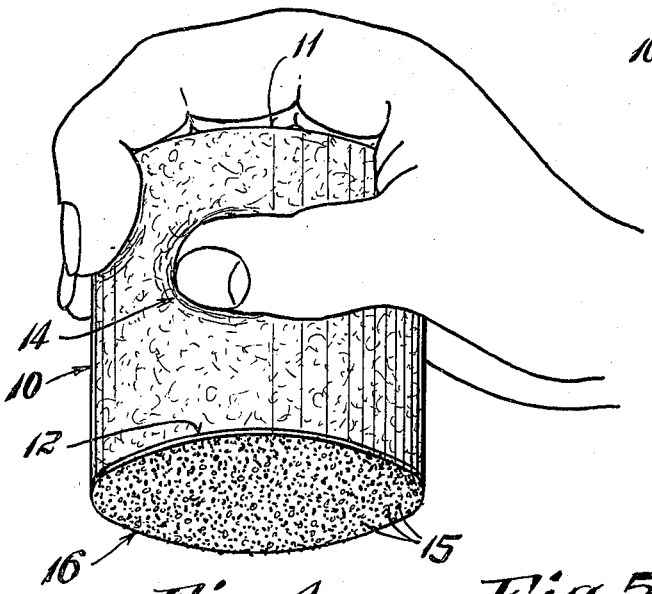
FIG. 1 is a perspective view of one embodiment of this invention showing the abrasive article held in the hand of a user and the bottom of the body having a layer of abrasive material thereon.
Figure 2:
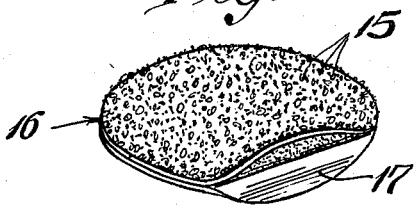
FIG. 2 is a perspective view of a replaceable abrasive-carrying disk for use with the holder shown in FIG. 1, the edge of the disk and the adjacent edge of the release paper being turned out to show the abrasive surface on one face and the adhesive surface on the other face.
Figure 3:
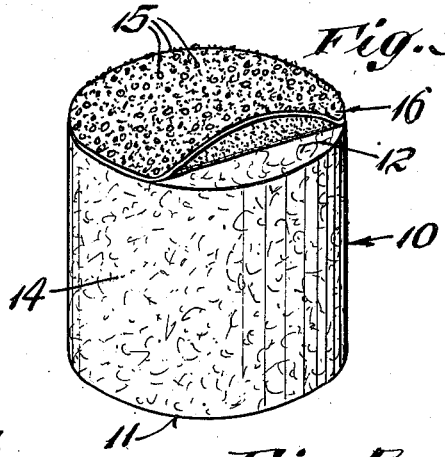
FIG. 3 is a perspective view showing the abrasive disk attached to the bottom of the body.
Figure 4:
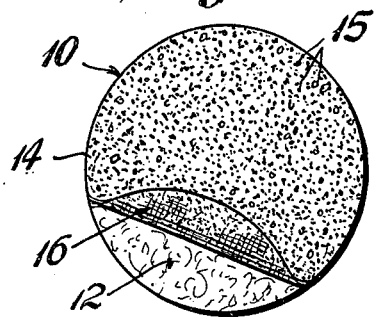
FIG. 4 is a view of the bottom of the body with a disk with the abrasive material carried on a cloth, such as emery cloth.

As shown in FIGS. 1 to 3, 7 and 10, the abrasive article of the present invention comprises a cylindrical body 10 having a flat top 11 and a generally flat bottom 12 as shown in FIGS. 1, 3, 4, 7 and 10 on which abrasive material is carried. The body 10 is formed of cellular plastic material, such as styrofoam, having a diameter of such size that the top 11 of the cylinder fits comfortably in the palm of the user's hand with the fingers and thumb gripping the sides 14 of the body as shown in FIG. 1. The body is of such height that, if the body is gripped as shown in FIG. 1, the fingers of the user's hand will not reach to or beyond the bottom of the body and thereby greatly reduce the chances of the user's fingers being injured in moving the body back and forth in use.

The body 10 is preferably sufficiently resiliently crushable, i.e., indentable, when it is squeezed by the thumb and fingers of the user's hand and thus is not likely to slip from and injure the hand even if the fingers are wet or greasy.

The body 10 being cellular is somewhat resiliently axially compressible and acts as a cushion between the user's hand and the work as the body is being pushed to and fro to perform the function of the article.

The diameter of the body 10 for an adult's use preferably is in the order of three inches and the height is in the order of 2 and one-half inches, but of course bodies of smaller or larger dimensions depending on its use may be made within the scope of this invention.

Figure 7:
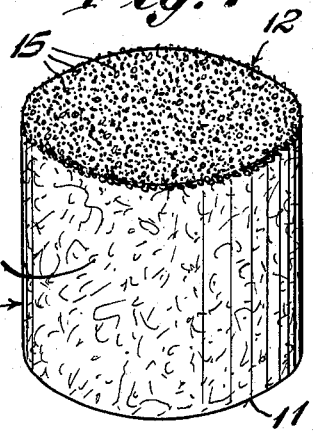
FIG. 7 is a view of an abrasive article in which the grits are adhered directly to the working end of the body.

The abrasive material may be, as indicated in FIG. 7, in the form of abrasive grits 15 glued or otherwise adhered to the bottom of the body. However, it is preferable according to the present invention to have the grits applied to a foundation disk 16 of paper, cloth or other substance which is cut to fit the bottom of the body and be adhesively attached thereto by the user, thus permitting the abrasive-carrying disk 16 to be removed from the end of the body 10 and discarded, being no longer useful, and a new disk to be applied to the body.

Another advantage which would result from using a removable and replaceable abrasive disk 16 would be the convenience of changing from coarse to less coarse abrasive material, for instance, as the finishing work is being carried out. The present invention contemplates furnishing an assortment of abrasive disks 16 having different grades of abrasive material.

Of course, in the broader aspects of this invention, the abrasive-carrying disks 16 may be furnished without factory-applied adhesive backs, but it is advantageous to have the disks 16 provided with a releasable adhesive layer covered with a piece 17 of glassine or other material which is easily stripped from the adhesive layer when preparing to apply a disk 16 to the body 10 and thereby permit the abrasive disks to be stacked in a package without sticking together.

Another advantage of the article of the present invention is that it is light in weight, and being formable by extrusion, is relatively inexpensive to manufacture and practically indestructible in its normal intended use.

The top of the body 10 of the article may have adhesively attached thereto a disk 18 of looped fiber strands and this may serve as a brush or mop to clean the work of dust formed thereon in the abrading operation or as an applicator for wax or other polishing materials.

Figure 5:
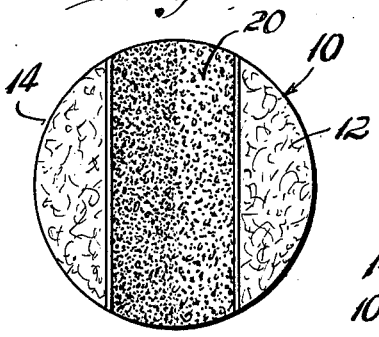
FIG. 5 is a bottom view of a modified form of an abrasive article in which the working end of the article has a V-shaped groove covered with adhesive material.
Figure 6:
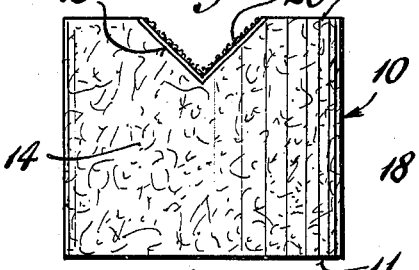
FIG. 6 is an elevation of the article shown in FIG. 5.

As shown in FIGS. 5 to 9 inclusive, the working surface of the body may be formed for special purposes. For instance, as shown in FIGS. 5 and 6, one end of the body may be provided with a right angle groove 19 in which a folded strip 20 of abrasive-carrying material having an adhesive back may be removably mounted. The article so arranged would be convenient in simultaneously sanding two surfaces of square molding, for instance.

Figure 8:
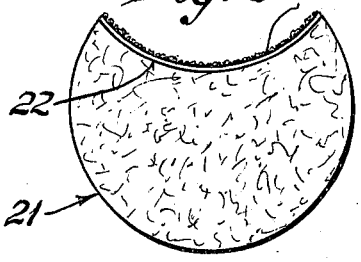
FIG. 8 is an end view of another modified form of an abrasive article.
Figure 9:
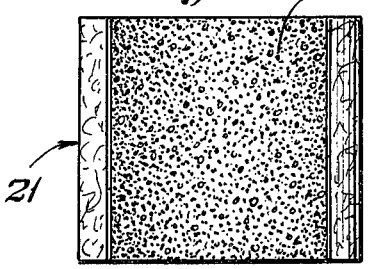
FIG. 9 is a side view of the article shown in FIG. 8.

Likewise, as shown in FIGS. 8 and 9, the side of the otherwise cylindrical body 21 may be formed with an arcuate surface 22 on which may be removably attached a rectangular strip 23 carrying on one surface abrasive material and on the opposite surface adhesive material.

Figure 11:
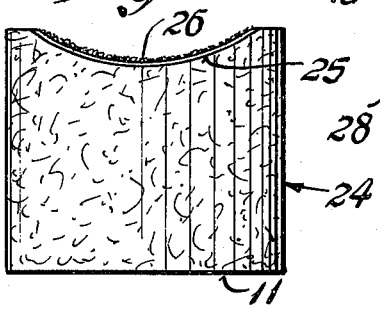
FIG. 11 is a plan view of an abrasive article having an arcuate groove into which an appropriately shaped abrasive sheet is adhered.

Instead of being angular, as shown in FIG. 5, the end of the otherwise cylindrical body 24 may have an arcuate groove 25, as shown in FIG. 11, in which an appropriately shaped abrasive sheet 26 may be releasably attached. So arranged, the article would be advantageous in smoothing convex or arcuate surfaces having a radius equal to or less than that of the groove 25.

Figure 10:
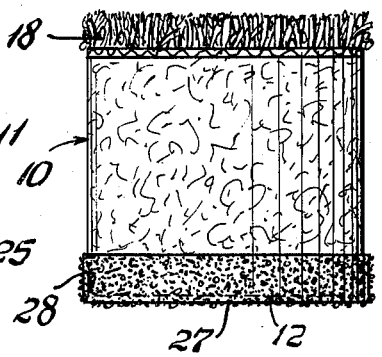
FIG. 10 is a side view of a form of this invention in which the top surface of the body is provided with a mop-like material.

As shown in FIG. 10, the disk 27 may have an upstanding peripheral flange 28 to form a cup into which the lower end of the body 10 slidably fits, the top of the disk 27 and/or the interior of the flange 28 being provided with adhesive material and the exterior of flange 28 and bottom of the disk 27 carrying abrasive material and would be convenient in smoothing right angle corners on a workpiece.

Variations and modifications may be made within the scope of the claims and portions of the improvements may be used without others.

I claim:

1. An abrasive article comprising a body formed of cellular plastic material carrying on its bottom end a piece of foundation material having adhered thereto on one side a layer of abrasive material such as used for sanding or scouring and on the opposite side a layer of adhesive material releasably attaching said foundation to the bottom surface of the cellular plastic material of said body, said body having a width of about three inches to fit within the palm of the hand of a medium-size user of the article and a height of about 2 and one-half inches whereby the bottom of the body extends beyond the tips of the user's fingers to keep them from protruding beyond the bottom of the body and engaging and possibly being injured by accidental contact with the article being worked upon, said body being resiliently crushable by the ends of the user's fingers while firmly gripping the sides of the body and the latter being axially resiliently compressible to cushion the pressure of the user's hand applied to the top end of the body in use, said foundation material being in the form of a shallow cup having a flat bottom and an integral rim portion projecting upwardly from said flat bottom and positioned to fit and slidably receive the bottom portion of said body, said abrasive material being carried on the exterior of the bottom and rim portion of said cup, said cup having on at least a portion of its interior surface said adhesive material by which the cup is releasably secured to the bottom of said body of cellular plastic material.

* * * * *